US005393405A

United States Patent [19]

Iacono et al.

[11] Patent Number: 5,393,405

[45] Date of Patent: Feb. 28, 1995

[54] METHOD OF ELECTROFORMING A GOLD JEWELRY ARTICLE

[75] Inventors: Steven J. Iacono; Robert S. Catanzaro, both of East Greenwich, R.I.

[73] Assignee: Ultralite Technology Incorporated, Attleboro, Mass.

[21] Appl. No.: 160,416

[22] Filed: Dec. 1, 1993

[51] Int. Cl.[6] ..... C25D 1/02

[52] U.S. Cl. ..... 205/72; 205/73

[58] Field of Search ..... 205/72, 73

[56] References Cited

U.S. PATENT DOCUMENTS

| | | | |
|---|---|---|---|
| 4,343,684 | 8/1982 | Lechtzin | 205/50 |
| 5,108,552 | 4/1992 | Desthomas | 205/82 |
| 5,172,568 | 12/1992 | Senanayake | 63/2 |

*Primary Examiner*—John Niebling
*Assistant Examiner*—Brendan Mee
*Attorney, Agent, or Firm*—Salter & Michaelson

[57] ABSTRACT

A method of electroforming gold jewelry articles utilizes a first gold/silver electroforming bath which is effective for depositing a relatively soft, ductile gold alloy, and a second gold/silver electroforming bath which is effective for depositing a hard, brittle gold alloy. Prior to the electroforming steps, the method includes the preliminary steps of forming a wax mandrel in a desired configuration, inserting a copper wire into the mandrel and applying a conductive lacquer onto the mandrel. The electroforming method includes the steps of alternately immersing the mandrel into the first and second electroforming baths and electroforming alternating layers of the soft and hard gold alloys over each other to form a laminated gold shell. After the last layer has been electroformed, the wax mandrel is melted and removed from the laminated gold shell thereby forming a hollow jewelry article. The alternating soft and hard layers cooperate to relieve internal stresses within the metal and thereby form a very strong and resilient metal shell. Since the laminated structure of the shell is stronger than a conventional electroformed shell, the thickness of the laminated gold shell can be reduced, and therefore the finished article can be made less expensively than a conventional gold shell.

5 Claims, No Drawings

METHOD OF ELECTROFORMING A GOLD JEWELRY ARTICLE

BACKGROUND AND SUMMARY OF THE INVENTION

The instant invention relates to electroforming processes and more particularly to a method of electroforming a gold jewelry article utilizing a plurality of different gold/silver electroforming baths.

Electroforming processes for forming jewelry articles have heretofore been known in the art. In this regard, the U.S. Pat. to Desthomas No. 5,108,552 and Lechtzin No. 4,343,684 represent the closest prior art to the subject invention of which the applicant is aware. The patent to Desthomas relates to an electroforming process wherein an electroformed shell is formed in a plurality of stages, however, only one electroforming bath is utilized. The Patent to Lechtzin relates to an electroforming process where an electroformed piece is formed in two stages utilizing two different plating solutions. The first or inner electroformed layer is formed as a non-precious metal layer, such as a copper layer, and the outer layer is formed as a relatively thick layer of a precious metal, i.e. gold, silver, etc. In this process, the final electroformed piece is annealed at an elevated temperature to relieve internal stresses in the metal, and then the annealed piece is immersed in an acid bath to remove the inner non-precious metal layer. While these known electroforming processes produce precious metal shells which are suitable for use in manufacturing costume jewelry articles, they have generally been found to be expensive, and they have been found to have high rejection rates due to irregular surface textures, and denting in the finished products thereby formed.

The instant invention provides a method of electroforming high quality gold jewelry articles utilizing a first gold/silver electroforming bath which is effective for depositing a relatively soft, ductile gold alloy, and a second gold/silver electroforming bath which is effective for depositing a hard, brittle gold alloy. Prior to the electroforming steps of the instant invention, the method includes the preliminary steps of forming a wax mandrel in a desired configuration, inserting a copper wire into the mandrel and applying a conductive lacquer onto the mandrel and copper wire. The instant electroforming method comprises the steps of alternately electroplating soft and hard gold alloy layers onto the mandrel to form a laminated gold shell. After the last layer has been electroformed, the wax mandrel is melted and removed from the gold shell thereby forming a hollow jewelry article. The gold shell is then polished and finished into a jewelry article, such as an earring or pendant. It has been found that the laminated soft and hard gold alloy layers cooperate to relieve internal stresses in the metal and form a very strong and resilient metal shell. It has further been found that since the laminated structure of the shell is stronger than a conventional electroformed shell, the thickness of the laminated gold shell can be reduced, and therefore the finished shell can be made less expensively than a conventional gold shell. It has still further been found that when the outer gold layer is polished it provides a highly reflective finish so that the hollow shell resembles a solid gold article.

Accordingly, it is an object of the instant invention to provide a method of electroforming gold jewelry articles.

It is another object of the invention to provide an effective method of electroforming an item of gold jewelry which is essentially free from internal stresses.

It is still another object to provide a method of electroforming gold jewelry articles having very thin, and strong outer shells.

It is yet another to provide a method of electroforming a hollow gold jewelry article having a highly reflective finish which resembles a solid gold jewelry article.

Other objects, features and advantages of the invention shall become apparent as the description thereof proceeds.

DESCRIPTION OF THE PREFERRED EMBODIMENT

As will hereinafter be more fully described, the instant invention provides a method of electroforming a gold jewelry article over a conductive mandrel using a plurality of different gold/silver electroforming baths each of which is effective for depositing a different gold alloy having a different hardness. More specifically, the subject invention utilizes a first gold/silver electroforming bath which is effective for depositing a soft, ductile gold alloy having a Vickers hardness between approximately 100 and 175, and a second gold/silver electroforming bath which is effective for depositing a hard, brittle gold alloy having a Vickers hardness between approximately 200 and 275. The subject method comprises the steps of alternately immersing a conductive mandrel in the above-referenced electroforming baths and electroforming soft and hard gold alloy layers onto the conductive mandrel to form a laminated gold shell. While the previous electroforming methods have been carried out using single electroforming bath to form a thick layer of gold, it has been found that by using different electroforming baths to deposit thin layers of gold having different hardnesses, the internal stresses typically associated with the prior art methods are significantly reduced or eliminated. It has also been found that the alternating soft and hard gold layers increase the strength of finished product thereby allowing a reduction in wall thickness.

Prior to the electroforming steps of the instant invention, the method preferably comprises the preliminary steps of forming a wax mandrel having a predetermined shape, cleaning and polishing the wax mandrel, inserting an electrically conductive lead wire, such as a copper wire, into the mandrel, applying an electrically conductive lacquer coating onto the mandrel, and heating the lacquer coated mandrel to a predetermined temperature. Thereafter, the instant electroforming method comprises the steps of alternately electroforming soft and hard gold alloy layers onto the conductive mandrel.

The wax mandrel used in the method of the subject invention is formed according to well known forming processes, and therefore no further description thereof is thought to be necessary. The step of cleaning and polishing the wax mandrel provides a uniform substrate surface so that the conductive lacquer adheres to the mandrel in an even distribution. The conductive lacquer is conventional in the art and is preferably applied by dipping the mandrel at least once into the lacquer while holding the mandrel with the conductive lead wire. The lacquer coated mandrel is thereafter heated to a temperature of approximately 110° C. in order to relieve internal stresses within the wax before the gold is electroformed thereon.

The steps of alternately electroforming soft and hard gold alloy layers more specifically preferably comprise the following steps:

(1) immersing a conductive mandrel in a first electroforming bath comprising a mixture of approximately 59% gold and 41% silver which produces a soft, ductile 14k gold alloy having a Vickers hardness of approximately 150, and electroforming a soft, ductile gold alloy layer onto the mandrel in a thickness between approximately 10 μm and 20 μm under the following conditions;

Current Density: 0.6–0.8 A/dm$^2$
Agitation Speed: 36–40 RPM
Bath Temp: 41° C.
pH Value: 11.3–11.7
Deposition Speed: 0.36 μm per minute at 0.6A/dm$^2$
0.48 μm per minute at 0.8 A/dm$^2$ (2) immersing the mandrel in a second electroforming bath comprising a mixture of approximately 75% gold and 25% silver which produces a hard, brittle 18k gold alloy having a Vickers hardness of approximately 250, and electroforming a hard, brittle gold alloy layer onto the mandrel in a thickness between approximately 3 μm and 8 μm under the following conditions;

Current Density: 1.0 A/dm$^2$
Agitation Speed: 40–50 RPM
Bath Temp: 20°–25° C.
Deposition Speed: 0.63 μm per minute (3) immersing the mandrel in the first electroforming bath and electroforming a soft, ductile gold alloy layer onto the mandrel in a thickness between approximately 10 μm and 20 μm under the following conditions;

Current Density: 1.2–1.4 A/dm$^2$
Agitation Speed: 58–64 RPM
Bath Temp: 41° C.
pH Value: 11.3–11.7
Deposition Speed: 0.72 μm per minute at 1.2A/dm$^2$
0.85 μm per minute at 1.4A/dm$^2$ (4) repeating step 2
(5) repeating step 3
(6) repeating step 2; and
(7) immersing the mandrel in the first electroforming bath and electroforming a soft, ductile gold alloy layer onto the mandrel in a thickness between approximately 25 μm and 55 μm under the same conditions as step 3.

The instant method preferably further includes the steps of heating the electroformed article to melt and remove the inner wax mandrel thereby resulting in a hollow, laminated gold shell. The outer gold layer is then polished by conventional means, and the laminated gold shell finished into a jewelry article, such as an earring or pendant. It is pointed out that the outer gold layer of the electroformed jewelry item has a greater thickness than the internal layers because the outer layer must be polished in the final manufacturing step. It is well known that polishing will remove a small amount of the outer layer, and accordingly, the outer layer is provided with an increased thickness to accommodate for the polishing. It has been found that when the outer gold layer is polished, it provides a highly reflective finish so that the hollow shell resembles a solid gold article.

It is noted that the above-described electroforming baths are commercially available from a variety of electroform material suppliers. It is also noted that various well known wetting and hardening agents may be added to the commercially available electroforming baths to change the hardness of the resulting gold alloy.

It has been found that the alternating electroformed layers of soft and hard gold alloys cooperate to form a laminated wall structure which increases the strength of the shell and simultaneously reduces the internal metallic stresses typically associated with electroformed articles. It has further been found that the laminated gold layers further increase the resiliency of the shell wall thereby making the shell highly resistant to denting or other deformations. It has still further been found that the increased strength of the laminated wall structure allows the finished jewelry article to have a reduced wall thickness, which reduces the amount and cost of gold used, and reduces the weight of the finished article.

EXAMPLE

In a specific example of the method of the subject invention, an article of jewelry was formed in a plurality of steps utilizing two different electroforming baths as follows:

Step 1 immersing a conductive mandrel in a first electroforming bath comprising a mixture of approximately 59% gold and 41% silver which produces a soft, ductile 14k gold alloy having a Vickers hardness of approximately 150, and electroforming a soft, ductile gold alloy layer onto the mandrel in a thickness of 10 μm under the following conditions;

Current Density: 0.6 A/dm$^2$
Agitation Speed: 36 RPM
Bath Temp: 41° C.
pH Value: 11.5
Deposition Speed: 0.36 μm per minute at 0.6A/dm$^2$
Deposition time: 27.8 minutes Step 2 immersing the mandrel in a second electroforming bath comprising a mixture of approximately 75% gold and 25% silver which produces a hard, brittle 18k gold alloy having a Vickers hardness of approximately 250, and electroforming a hard, brittle gold alloy layer onto the mandrel in a thickness of 3 μm under the following conditions;

Current Density: 1.0 A/dm$^2$
Agitation Speed: 44 RPM
Bath Temp: 20° C.
Deposition Speed: 0.63 μm per minute
Deposition time: 4.7 minutes Step 3 immersing the mandrel in the first electroforming bath and electroforming a soft, ductile gold alloy layer onto the mandrel in a thickness of 10 μm under the following conditions;

Current Density: 1.2 A/dm$^2$
Agitation Speed: 60 RPM
Bath Temp: 41° C.
pH Value: 11.5
Deposition Speed: 0.72 μm per minute at 1.2 A/dm$^2$
Deposition time: 13.9 minutes (4) repeating step 2
(5) repeating step 3
(6) repeating step 2; and
(7) immersing the mandrel in the first electroforming bath and electroforming a soft, ductile gold alloy layer onto the mandrel in a thickness of 50 μm under the same conditions as step 3.

The above steps produced an electroformed jewelry item having a laminated wall thickness of approximately 100 μm. While conventional electroforming processes require a wall thickness of approximately 150

μm for sufficient stability and rigidity, it was found that a laminated wall thickness of approximately 100 μm provided the same stability and rigidity as the thicker conventional gold shell with an effective savings in material and weight of approximately one third. In the finishing steps of the method, the laminated gold shell was heated to melt and remove the inner wax mandrel, and the outer surface was polished according to conventional methods. Unlike the irregular surface textures of jewelry items formed according to the prior art, it was found that polishing the outer surface of the jewelry item produced a highly reflective finish so that the hollow shell resembled a solid gold jewelry article. It was further found that the laminated gold wall structure was more resilient than the prior art gold shells and was therefore more resistant to denting.

It can be seen that the laminated gold shell structure formed by the instant electroforming method is much stronger and more resilient than gold shells formed by conventional electroforming techniques. Since the wall thickness is reduced, the cost and weight of the finished article are also reduced. For these reasons, the instant invention is believed to represent a significant advancement in the art which has substantial commercial merit.

While there is described herein certain specific steps and compositions of matter embodying the invention, it will be manifest to those skilled in the art that various modifications and rearrangements of the steps may be made without departing from the spirit and scope of the underlying inventive concept, and that the same is not limited to the particular forms herein described except insofar as indicated by the scope of the appended claims.

We claim:

1. A method of forming an electroformed gold jewelry article comprising the steps of:

immersing a conductive mandrel in a first electroforming bath which is effective for depositing a first gold alloy having a Vickers hardness between approximately 100 and 175, and electroforming a layer of said first gold alloy onto said mandrel in a predetermined thickness; and immersing said mandrel in a second electroforming bath which is effective for depositing a second gold alloy having a Vickers hardness between approximately 200 and 275, and electroforming a layer of said second gold alloy onto said mandrel in a predetermined thickness.

2. A method of forming an electroformed gold jewelry article comprising the steps of:

immersing a conductive mandrel in a first gold and silver electroforming bath which is effective for depositing a first gold alloy having a Vickers hardness between approximately 100 and 175, and electroforming a layer of said first gold alloy onto said mandrel in a predetermined thickness; and immersing said mandrel in a second gold and silver electroforming bath which is effective for depositing a second gold alloy having a Vickers hardness between approximately 200 and 275, and electroforming a layer of said second gold alloy onto said mandrel in a predetermined thickness.

3. The method of claim 2 further comprising the step of alternately repeating said steps of immersing said mandrel in said first and second electroforming baths and electroforming layers of said first and second gold alloys until a desired overall laminated thickness is achieved.

4. The method of claim 2 further comprising the step of immersing said conductive mandrel in said first electroforming bath, and electroforming an outer layer of said first gold alloy onto said conductive mandrel in a predetermined thickness.

5. A method of forming an electroformed gold jewelry article utilizing a first gold and silver electroforming bath which is effective for depositing a first gold alloy having a Vickers hardness between approximately 100 and 175, and a second gold and silver electroforming bath which is effective for depositing a second gold alloy having a Vickers hardness between approximately 200 and 275, said method comprising the steps of:

immersing a conductive mandrel in said first electroforming bath and electroforming at a current density between approximately 0.6 and 0.8 $A/dm^2$, and an agitation speed between approximately 36 and 40 RPM a layer of said first gold alloy onto said mandrel in a thickness between approximately 10 μm and 20 μm;

immersing said mandrel in said second electroforming bath and electroforming at a current density of approximately 1.0 $A/dm^2$, and an agitation speed between approximately 40 and 50 RPM a layer of said second gold alloy onto said mandrel in a thickness between approximately 3 μm and 8 μm;

immersing said mandrel in said first electroforming bath and electroforming at a current density between approximately 1.2 and 1.4 $A/dm^2$ and an agitation speed between approximately 58 and 64 RPM a layer of said first gold alloy onto said mandrel in a thickness between approximately 10 μm and 20 μm;

immersing said mandrel in said second electroforming bath and electroforming at a current density of approximately 1.0 $A/dm^2$ and an agitation speed between approximately 40 and 50 RPM a layer of said second gold alloy onto said mandrel in a thickness between approximately 3 μm and 8 μm;

repeating said previous two steps of alternately immersing and electroforming; and immersing said mandrel in said first electroforming bath and electroforming at a current density between approximately 1.2 and 1.4 $A/dm^2$ and an agitation speed between approximately 58 and 64 RPM a layer of said first gold alloy onto said mandrel in a thickness between approximately 25 μm and 55 μm.

* * * * *